United States Patent [19]

Denny et al.

[11] 4,235,469

[45] Nov. 25, 1980

[54] PIPE HANDLING APPARATUS

[75] Inventors: Lawrence A. Denny, Orange, Calif.; James E. Aswell, Houston, Tex.

[73] Assignee: Den-Con Tool Company, Orange, Calif.

[21] Appl. No.: 38,248

[22] Filed: May 11, 1979

[51] Int. Cl.[3] ..... E21C 19/00

[52] U.S. Cl. ..... 294/96; 294/86.25

[58] Field of Search ..... 294/86.25, 86.24, 86.21, 294/86.15, 86.13, 86.14, 86.1, 86 R, 86 A, 93, 95, 97, 96; 166/212, 216, 217; 405/158, 199

[56] References Cited

U.S. PATENT DOCUMENTS

| | | | |
|---|---|---|---|
| 2,231,206 | 1/1942 | Pollard et al. | 294/95 |
| 2,523,972 | 9/1950 | Sharratt et al. | 308/15 |
| 2,624,610 | 1/1953 | Murphy | 294/96 |
| 2,648,563 | 8/1953 | Hall | 294/96 |
| 2,687,324 | 8/1954 | Grunsky et al. | 294/96 |
| 2,939,739 | 6/1960 | Grunsky | 294/96 |
| 3,265,431 | 8/1966 | Burner | 294/86.25 |
| 3,638,989 | 2/1972 | Sandquist | 294/96 |
| 3,709,546 | 1/1973 | Vaughan | 294/96 |
| 3,801,148 | 4/1974 | Rosgon et al. | 294/93 |

*Primary Examiner*—James B. Marbert

*Attorney, Agent, or Firm*—Pravel, Gambrell, Hewitt, Kirk, Kimball & Dodge

[57] ABSTRACT

An apparatus for insertion into the interior of large diameter pipe or tubing which engages inner portions of the pipe so that the pipe may be lifted and moved. Slip assemblies are wedged into engagement with inner portions of the pipe. The amount of wedging may be varied with a hydraulic cylinder or other suitable power source. Pipe guide members are provided to insure centering of the apparatus within the pipe.

5 Claims, 3 Drawing Figures

PIPE HANDLING APPARATUS

BACKGROUND OF INVENTION

1. Field of Invention:

The present invention relates to apparatus for grasping, handling and movement of large diameter pipes and tubing and other tubular members.

2. Description of Prior Art:

Large inner diameter pipes and tubing are coming into increasing use in hydrocarbon drilling and production operations, for example in platform installations and the like. In assembling sections or strings of these large diameter pipe, it is necessary to handle and move them. The problems of gripping and moving large hollow pipes and tubing were considerable. U.S. Pat. No. 3,265,431 is the only patent known to applicants dealing specifically with handling and moving of large diameter tubular members. Due to the size and weight of this type of tubular members, stability and balance of handling of these members was important. For this reason, any minor misalignment between structure in the gripping apparatus for engaging the tubular member and the members could cause handling problems during lifting or other movement. Also, misalignment between the handling structure and the tubular member could cause loading problems.

Other types of prior patents relating to engagement with the interior of tubular structure are set forth in U.S. Pat. Nos. 2,523,972; 2,624,610; 2,468,563; 2,687,324; 2,939,739 and 3,709,546. However, so far as is known, these types of structures have not been used with large diameter tubular members.

SUMMARY OF INVENTION

Briefly, the present invention provides new and improved apparatus for engaging the interior of tubular members for movement and handling. A plurality of slips which engage an inner wall of the tubular member are urged outwardly to engage the wall by means of a ramp during relative movement between the slips and the ramp. A cylinder operating under fluid power, from a hydraulic or pneumatic pressurized fluid, causes relative movement between the slips and the ramp to urge the slips outwardly and to retract them. A leveling beam member is provided to transfer movement from the fluid power cylinder to the slips to cause substantially uniform engagement between the slips and the tubular member and to also cause balanced loading during movement and handling of the tubular member.

DESCRIPTION OF THE PREFERRED EMBODIMENT

Figure 1:
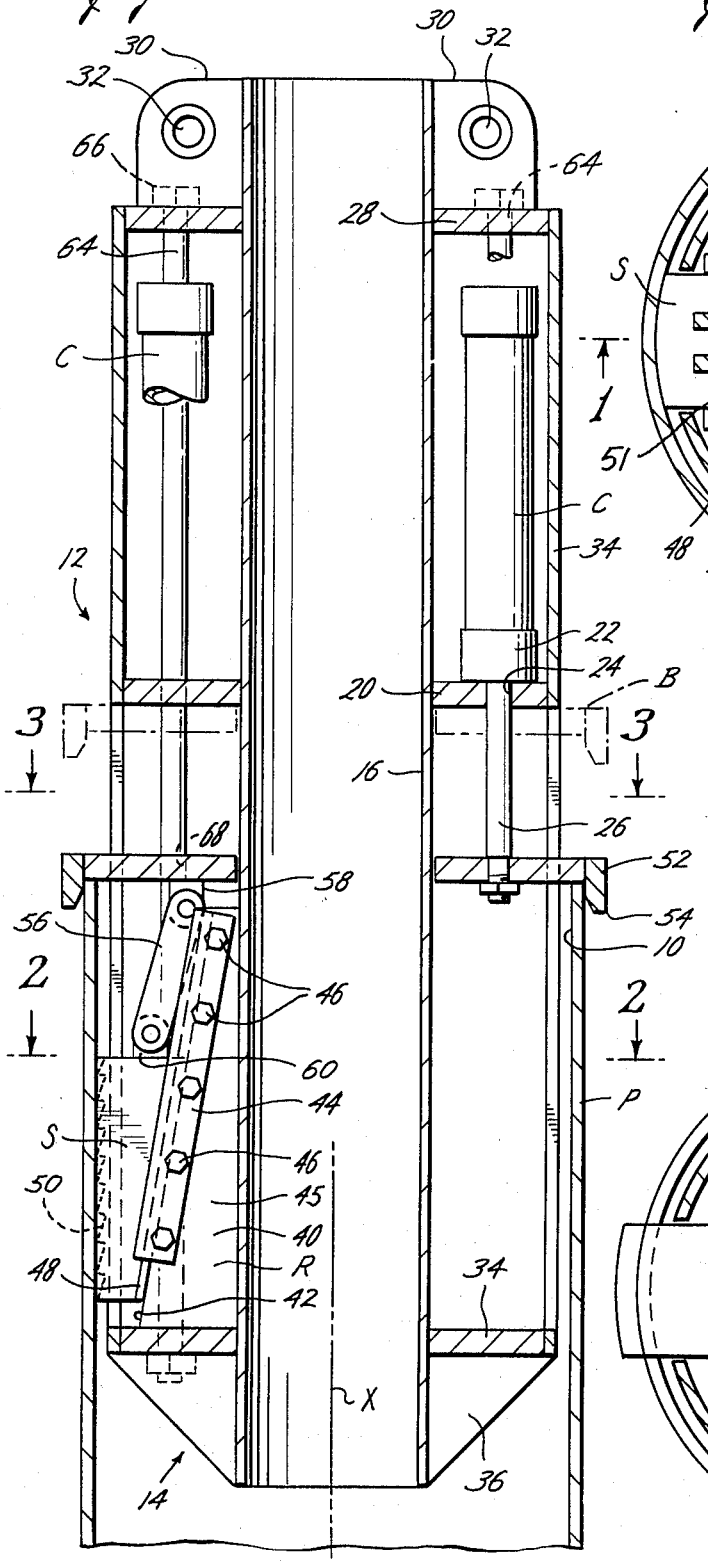
FIG. 1 is an elevation view, taken in cross-section, of an apparatus according to the present invention.
Figure 2:
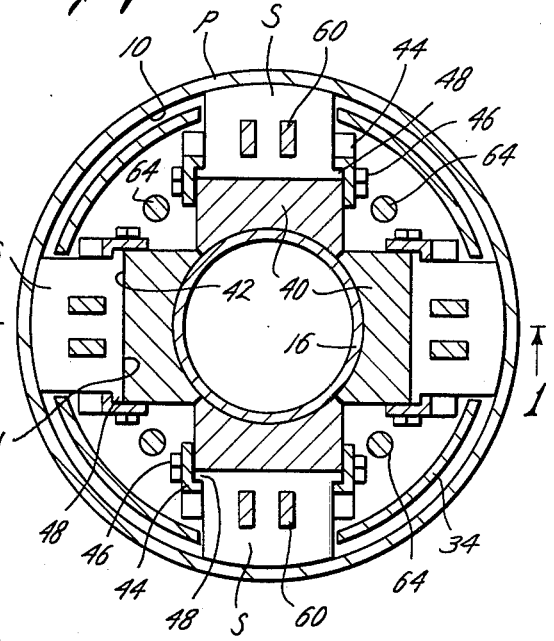
FIG. 2 is a cross-sectional view taken along the lines 2—2 of FIG. 1.

In the drawings, the letter A designates generally an apparatus according to the present invention for engaging an internal surface 10 of a pipe or other suitable tubular member P of large inner diameter, such as those used in platform pilings or other offshore locations. Once the apparatus A has engaged the tubular member P, the member P may be moved about a pipe-laying barge or other location for storage, installation or the like. A typical inner diameter for a tubular member P according to the present invention would be, for example, on the order of forty to sixty inches. It should be understood that although the member P is shown with a longitudinal axis X extending vertically in the drawings for ease of illustration, such members would typically be stacked in racks with the axis X extending horizontally during initial engagement with the apparatus A.

The apparatus A includes a body member in the form of an outer body member 12 and a inner body member 14 to be inserted into the member P. The outer body member 12 and the inner body member 14 are interconnected by a central post member 16 of tubular or other suitable configuration which extends therebetween.

The apparatus A further includes a plurality of slips S which engage the inner wall 10 of the tubular member P as they move along ramp structure R in response to force exerted by a fluid powered cylinder C. The number of cylinders C may vary and is determined by the required amount of gripping force to be exerted by the slips S. The cylinders C respond to the receipt of pressurized operating hydraulic or pneumatic fluid to cause relative movement between the slips S and the ramp R. A leveling beam B is provided between the cylinder C and the slips S to transfer movement from the cylinder C to the slips S and thereby cause substantially uniform engagement, as will be set forth, between the slips S and the inner wall 10 of the member P at a common longitudinal distance into the interior thereof.

Considering the outer body member 12 in detail, a support plate 20 is formed at an inner portion thereof so that the cylinder C may be mounted therewith at an inner portion 22 thereof. An opening is formed in the support plate 20 adjacent a surface 24 to permit an operating shaft 26 of the cylinder C to extend therethrough for connection with the leveling beam B. The operating shaft 26 moves upwardly and downwardly in the position shown in FIG. 1 to cause corresponding movement of the leveling beam B. Downward movement of the leveling beam B causes the slips S to be wedged outwardly towards member P by the ramp structure R, while upward movement of the beam B moves the slips inwardly from member P.

The outer body member 12 further includes an outer end plate 28 to which are connected a plurality of lifting pads 30 having lifting eyes 32 formed therein. Suitable lifting structure, such as hooks, cables or other mechanisms may be attached to the lifting pads 30 through the lifting eyes 32 so that the tubular member P may be moved and handled once engaged by the apparatus A, as will be set forth below. A cylindrical wall member 34 is mounted with the outer end plate 28 and the support plate 20 to enclose the fluid power cylinders C within the body member 12.

The inner body member 14 includes an inner support member 34 mounted with the center post member 16 at a portion thereof opposite outer body member 12. Preferably, suitable tapering guide struts 36 are formed on the support member 34 for ease of insertion of the inner portion of the apparatus A into the tubular member P.

The ramps R according to the present invention may take the form of a plurality of individual wedge members 40, one for each of the slips S, having a wedge-shaped outer surface 42 which urges the corresponding slip S outwardly into engagement with the inner surface 10. Alternatively, the ramps R of the present invention may take the form of a single cylindrical member having an external conical surface to accomplish the same function. The wedge pieces 40 of the ramp may be mounted with the lower support member 36 and with the center post member 16 by welding or, alternatively, by suitable mounting structure. Channel-shaped retainer arm members 44 are mounted on each side surface 45 of the wedge members 40 by bolts 46 or other suitable means in order to confine therewithin side shoulder portions 48 of the slips S to keep the slips S in position on the ramp members 40.

The slip members S may have a smooth external surface for engaging the interior portion of a tubular member P, particularly when such a tubular member has an internal upset formed therein. However, it is preferable that the slip members S have teeth or gripping dogs, (as shown in phantom at 50) where the tubular member P has a relatively substantially smooth inner surface wall 10, to ensure adequate gripping force therebetween. Each of the slip members S has a tapered inner surface 51 corresponding to the surface 42 on the ramp S, so that as the cylinder C causes downward movement of beam B and the slips S, the slip members S are urged outwardly into gripping contact with the inner surface 10 of the tubular member P.

Each of the slips S is connected to the cylinder C by means of the leveling beam B so that relative movement caused by the cylinder C can be uniformly transmitted through the leveling beam B to each of the slips S and ensure substantially uniform engagement between the slips S and the inner wall 10. In this manner, substantially uniform alignment of the slip members S along the longitudinal axis X of the tubular member P is obtained. Further, such uniform engagement ensured balanced loading between the tubular member P and the apparatus A on the one hand and the lifting structure connected thereto through the lifing eyes 32 on the other hand.

The leveling beam B is connected to the piston shaft 26 of the cylinder C at a lower end thereof by a suitable connecting means, such as a bolt as shown. Further, a plurality of external centering lugs 52 are formed about the periphery of the leveling beam B with a tapered centering lip 54 formed thereon in order to center the apparatus onto the tubular member during the final stages of engaging the member P, further ensuring uniformity of loading and alignment of the tubular member P during lifting or other movement operations.

Each of a plurality of linkage arm members 56 is pivotally connected to a clevis member 58 mounted with the leveling beam B. Each arm member 56 is also pivotally connected at a lower end to a clevis member 60 mounted on one of the slips S to interconnect the slip members S and the leveling beam B. The pivotal connections at both ends of the linkage member 56 allows for the continued sliding coaction between the slips S and the ramps R during inward movement of the leveling beam B and the slips S in response to the cylinder C, to and from an engaged position (FIG. 1) and an extracted position (as leveling beam B is shown in phantom, FIG. 1).

Figure 3:
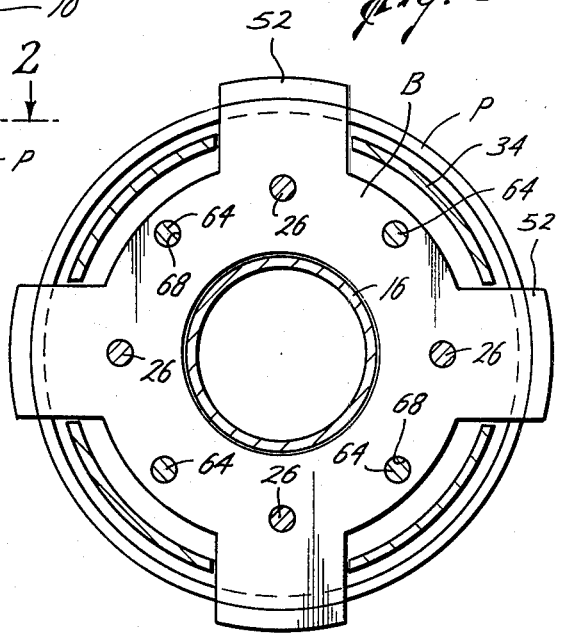
FIG. 3 is a cross-sectional view taken along the lines 3—3 of FIG. 1.

Guide rods 64 are provided in the apparatus A and are mounted at head portions 66 to the end plate 28, extending through the support plate 20 through suitable openings formed therein, and extending further through the leveling beam B through suitable openings adjacent surfaces 68 (FIG. 3) to a connection with the support member, 34. It is to be noted that the guide rods 64 extend through three relatively fixed members, namely the upper end plate 28, support plate 20 and lower support member 34, rigidly connecting the same to each other. However, the guide rods 64 further extend through the openings formed adjacent surfaces 68 in the movable leveling beam B to guide the beam B and the slips S during movement of slips S into and out of engagement with the tubular member P.

During the operating of the present invention, the body member 14 of the apparatus A is inserted into an open end of a tubular member P to be hoisted or moved or otherwise handled, with the body member 14 being substantially in the position shown in the drawings, with the leveling beam B being at the position shown in the phantom (FIG. 1). The cylinders C are then activated, and the slips S are forced downwardly by means of the linkage arms 56 and the leveling beam B. During progressive downward movement thereof, the slips S are moved outwardly into firm gripping contact with the inner surface 10 of the tubular member P. As the limit of downward movement is approached, the centering lip 54 of the lugs 52 engages the member P and assures that the apparatus A is centrally located with respect to the longitudinal axis X of the tubular member P, thereby confinging the apparatus A into the position. Leveling beam B then engages the tubular member P as shown in FIG. 1 and movement thereof in response to the cylinder C is stopped. Because of the load transferring characteristic of the leveling beam B, to the slips S through substantially equal engagement between each of the slips S with the member P at a common distance into the interior thereof, ease of movement and handling of the tubular member P is obtained. The leveling beam B further distributes the loading imposed on the lifting structure connected to the lifting eyes 32.

Although in the embodiment shown in the drawings, the slips S move in response to the cylinders C, it should be understood that the ramps R may be moved in response to the cylinders C relative to the slips S.

The foregoing description and disclosure of the present invention are illustrative and explanatory thereof and various changes in the size, shape, and materials as well as in the details of the preferred embodiment may be made without departing from the spirit of the invention.

We claim:

1. An apparatus for engaging the interior of a tubular member for movement and handling thereof, comprising:

(a) a plurality of slips for engaging an inner wall of the tubular member;

(b) ramp means for urging said plurality of slips outwardly during relative movement therebetween to engage the inner wall of the tubular member;

(c) fluid power cylinder means for causing relative movement between said plurality of slips and said ramp means;

(d) leveling beam means for transferring movement from said fluid power cylinder means to said plurality of slips to cause substantially uniform engagement between said plurality of slips and the inner wall of the tubular member and balanced loading during movement and handling thereof;

(e) guide rod means for guiding movement of said slips and said leveling beam means with respect to the tubular member;

(f) an outer body member having:

(1) an outer end plate for attachment to said guide rod means;

(2) a support plate for mounting said fluid power cylinder means therewith, said support plate having an opening for passage therethrough of said guide rod means;

(g) said leveling beam means having an opening for passage of said guide rod means therethrough; and (h) an inner body member having an inner support member for mounting said ramp means therewith, said inner body member having said guide rod means attached thereto.

2. The apparatus of claim 1, further including:

retainer arm means for connecting said plurality of slips on said ramp means.

3. The apparatus of claim 1, further including:

a centering lip formed on said leveling beam means for centering the apparatus onto the tubular member.

4. The apparatus of claim 1, wherein:

said plurality of slips having gripping dies formed thereon for engaging relatively smooth inner walls of tubular members.

5. The apparatus of claim 1, wherein:

said plurality of slips having smooth gripping surfaces for contact with tubular members having inner contact surfaces.

* * * * *